United States Patent [19]

Dang et al.

[11] Patent Number: 4,660,308

[45] Date of Patent: Apr. 28, 1987

[54] TENTERING FRAME FOR SHEET-LIKE MEMBERS

[75] Inventors: Hiep D. Dang; Roy L. Hicks; Joel F. M. Leathers, all of Lake Jackson, Tex.

[73] Assignee: The Dow Chemical Company, Midland, Mich.

[21] Appl. No.: 759,768

[22] Filed: Jul. 29, 1985

[51] Int. Cl.[4] ..... D06C 3/08

[52] U.S. Cl. ..... 38/102.4; 38/102.91; 160/380; 204/285

[58] Field of Search ..... 38/102.1, 102.2, 102.91, 38/102.4, 102.5; 160/380, 382, 383, 400, 403, 402, 378, 395, 391, 392; 204/255, 268, 252, 245, 285; 223/96

[56] References Cited

U.S. PATENT DOCUMENTS

| | | | |
|---|---|---|---|
| 381,204 | 4/1888 | Bailey | 38/102.4 |
| 730,230 | 6/1903 | Burrowes | 160/395 |
| 1,055,489 | 3/1913 | Pendery | 160/380 |
| 1,711,670 | 5/1929 | Brennan | 160/395 |
| 2,109,425 | 2/1938 | Hurxthal | 38/102.91 X |
| 2,803,086 | 8/1957 | Ross | 38/102.1 |
| 2,834,412 | 5/1958 | Velke | 160/395 |
| 2,893,162 | 7/1959 | Knowles | 38/102.1 |
| 3,050,222 | 8/1962 | Cates | 223/96 |
| 3,482,343 | 12/1969 | Hamu | 38/102.91 X |
| 3,507,062 | 4/1970 | Moyer | 38/102.91 |
| 3,553,862 | 1/1971 | Hamu | 38/102.1 |
| 3,729,045 | 4/1973 | MacDonald | 160/395 X |
| 3,767,092 | 10/1973 | Garrison et al. | 223/96 |
| 3,962,805 | 6/1976 | Hamu | 38/102.5 |
| 4,010,879 | 3/1977 | George et al. | 223/96 |

FOREIGN PATENT DOCUMENTS

| | | | |
|---|---|---|---|
| 260896 | 12/1911 | Fed. Rep. of Germany | 38/102.1 |
| 549259 | 3/1955 | Italy | 38/102.1 |

*Primary Examiner*—Werner H. Schroeder
*Assistant Examiner*—Andrew M. Falik
*Attorney, Agent, or Firm*—Joe R. Prieto

[57] ABSTRACT

A tentering apparatus for tensioning a sheet-like member, for example, a membrane used in an electrolyzer. The apparatus includes four clamping assemblies arranged in a frame-shape configuration within an outer frame member, and a fastener, such as a threaded bolt and wing unit, for fastening the clamping assemblies to the outer frame members and for tensioning the sheet-like member.

9 Claims, 6 Drawing Figures

TENTERING FRAME FOR SHEET-LIKE MEMBERS

BACKGROUND OF THE INVENTION

This invention relates to an apparatus and method for tentering sheet-like members and more particularly this invention relates to a tentering frame and method for tentering membranes used in electrolyzers.

Electrolyzers employing a membrane (hereinafter "membrane cells") may be of the filter press-type, for example, as described in U.S. Pat. Nos. 4,108,742 and 4,111,779. Membrane materials commonly used for membrane cells include, for example, those marketed by E. I. duPont de Nemours & Company under the trademark Nafion® and by Asahi Glass Company Ltd. under the trademark Flemion®. The membranes are available principally in sheet-like form. The membrane is used for separating the cell into electrode compartments containing electrolyte. For example, a membrane cell used for the production of a halogen and an alkali metal hydroxide may use an ion exchange membrane to separate an anode compartment containing anolyte and an anode member from a cathode compartment containing catholyte and a cathode member.

In a membrane cell used, for example, in the production of a halogen and an alkali metal hydroxide, it is important to keep the distance between electrodes to a minimum to reduce the voltage drop through the catholyte and anolyte, and thus reduce energy consumption of the cell. Furthermore, it is advantageous to keep a uniform spacing between an electrode and the membrane to obtain a uniform current distribution. Any contact between the membrane and an electrode may cause a great amount of current passage and membrane burning at the point of contact. In some applications, the spacing between an electrode and membrane may be no greater than 1 millimeter. Therefore, the membrane is kept as flat or planar as possible when installed between electrodes of an electrolytic cell.

Some membrane materials are known to absorb water and expand a certain percentage when wetted. Thus, it is common for these types of membranes to form wrinkles during operation of a cell when the membrane is wetted with electrolyte. A wrinkled membrane can come into contact with the cell electrodes and cause the problems described above. A wrinkled membrane can also reduce the circulation of the electrolyte and trap gases produced in the cell between the electrode and the membrane face. This may result in a non-uniform increase in resistivity of the electrolyte solution in the interelectrode space with a non-uniform current distribution across the membrane surface in the vertical direction. It is important, therefore, to keep the membrane as flat as possible and prevent wrinkles from forming on the membrane surface when installing in the cell.

Heretofore, the installation of membranes between electrode compartments required a crew of about six to eight people holding the membrane in place and pulling the membrane by hand to tension the membrane between electrode units until the electrode compartment units were squeezed together by, for example, a hydraulic ram. Invariably, this procedure led to formation of wrinkles on the membrane due to uneven forces pulling at the membrane by the crew. The wrinkles formed at a gasket bearing surface of the membrane caused leakage of electrolyte into the atmosphere or electrode compartments. Furthermore, installation of the membrane consumed a relatively long period of time and dropping the membrane, which meant starting the installation process over, was always a risk.

It is desired to minimize the problems discussed above by providing an apparatus and method for tentering a membrane used in a membrane cell and maintaining the membrane planar when installed in a membrane cell.

SUMMARY OF THE INVENTION

The present invention is directed to an apparatus and method for tentering a generally planar sheet-like member. The apparatus comprises (a) an outer frame member, (b) at least four clamping assemblies adjacent to each other and arranged in a picture-frame type configuration inside the outer frame member and spaced apart from the outer frame member, said clamping assemblies adapted for clamping at least a portion of the periphery of the sheet, said clamping assemblies comprising a pair of independent and separate elongated, generally planar members adjacent and parallel to each other and fixed together with a first fastening means, and (c) a second fastening means for fastening at least one of the clamping means to the outer frame member.

DETAILED DESCRIPTION OF PREFERRED EMBODIMENTS

Figure 1:
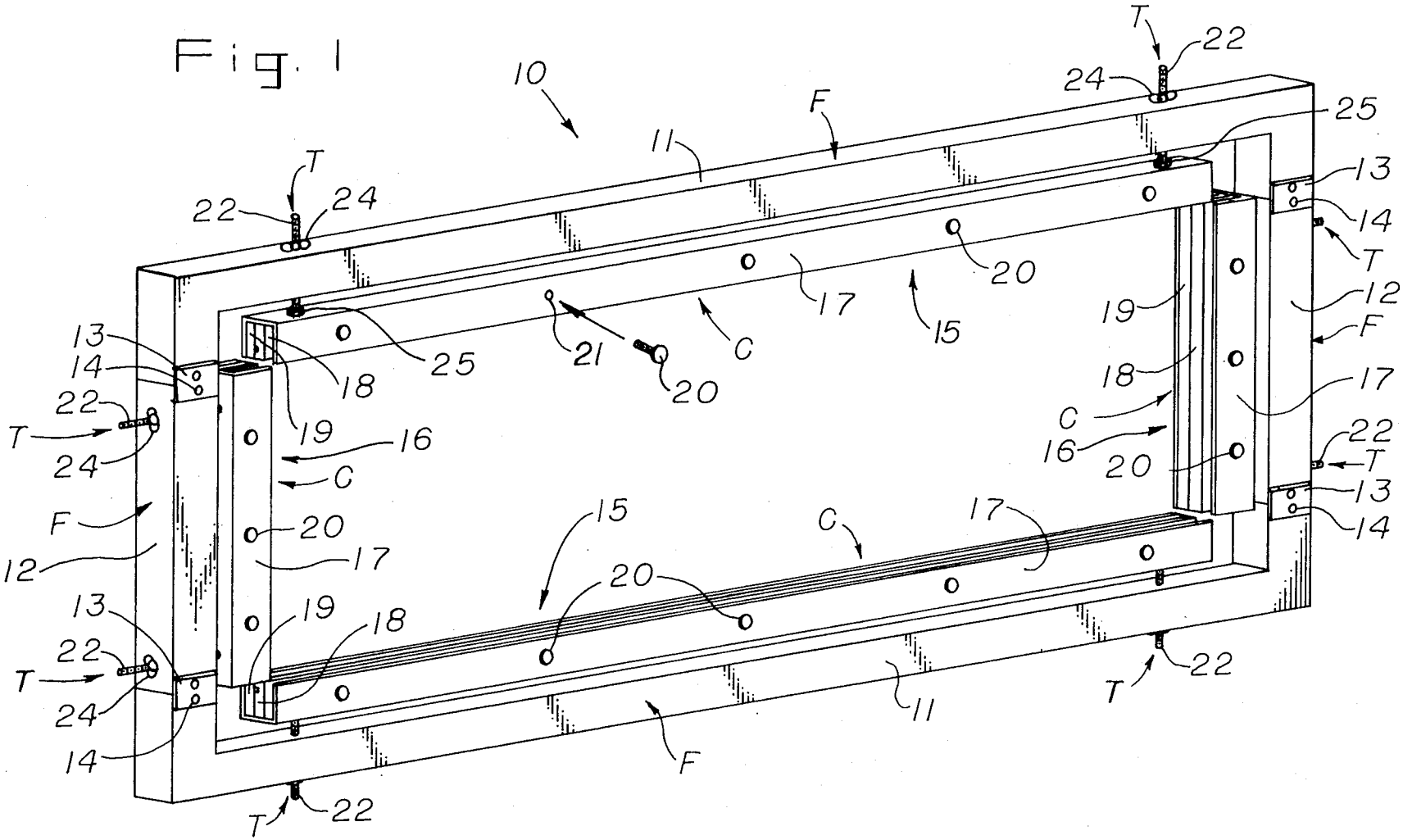
FIG. 1 is a perspective view of one embodiment of the tentering apparatus according to the present invention showing an outer frame member and four clamping assemblies in a picture type configuration.
Figure 2:
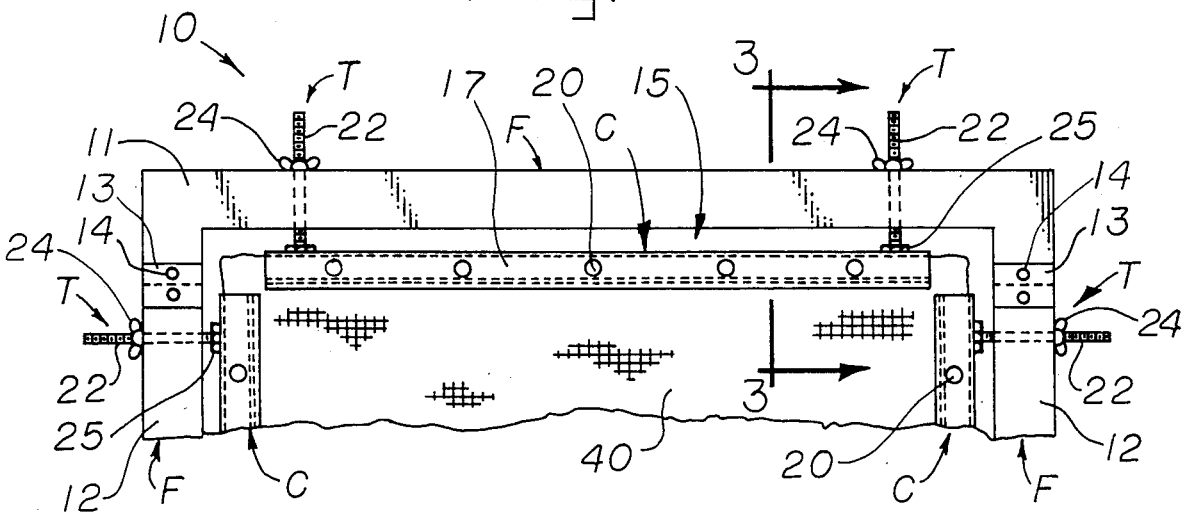
FIG. 2 is a front view of a portion of an assembled tentering apparatus of FIG. 1 with a sheet-like member.

With reference to FIGS. 1–6, there is shown various preferred embodiments of the apparatus of the present invention which is designated generally as numeral 10 (hereinafter tentering frame 10). As shown in FIG. 1, the tentering frame 10 may consist essentially of an outer frame member F and four clamping assemblies C positioned inside the outer frame member in a picture frame type configuration. The tentering frame 10 is used for tensioning a sheet-like member 40, as shown in FIG. 2. The tentering frame 10, in this instance, is rectangular in shape, but broadly speaking, the tentering frame may be any shape as that of the sheet-like member, for example, square or hexagonal.

The outer frame member F may be a one-piece, rectangular-shaped member having two long sides and two short sides. In another embodiment, the outer frame member F may be a multi-section, rectangular-shaped member. Preferably, the outer frame member F is in four sections for ease in assembling and disassembling.

The outer frame member F may consist essentially of a first pair of longitudinal sections 11 generally parallel and spaced apart positioned between a second pair of transversal sections 12 generally parallel and spaced apart. A means for fastening together the sections 11 and 12 of the outer frame member F may be, for example, a support flat plate 13 and bolts 14.

The tentering frame 10 contains at least four clamping assemblies C positioned inside the outer frame member F. Two of these clamping assemblies, each indicated by numeral 15, are attached to each of the outer frame member sections 11 by a fastening means T. In accordance with the present invention, the fastening means T is also used for tentering the sheet-like member 40 and, therefore, will be referred herein as the "fastening/tentering" means T. The other two clamping assemblies, each indicated by a numeral 16, are attached to each of the outer frame member sections 12 by a fastening/tentering means T.

The clamping assemblies 15 and 16 comprise a U-shaped clamp channel 17 and a first and second clamping bar 18 and 19, parallel and adjacent each other and juxtaposed between the arms of the "U" or flanges of the U-shaped clamp channel 17. "U-shaped" refers to the view of the channel member 17 in cross-section. A releasable means for tightening the first and second clamping bars together may be used in the form of a plurality of clamping screws 20 and threaded openings 21 adapted to receive the clamping screws 20. The clamping screws 20 and the threaded openings 21 are preferably located on at least one flange of the U-shaped clamp channel 17.

Figure 3:
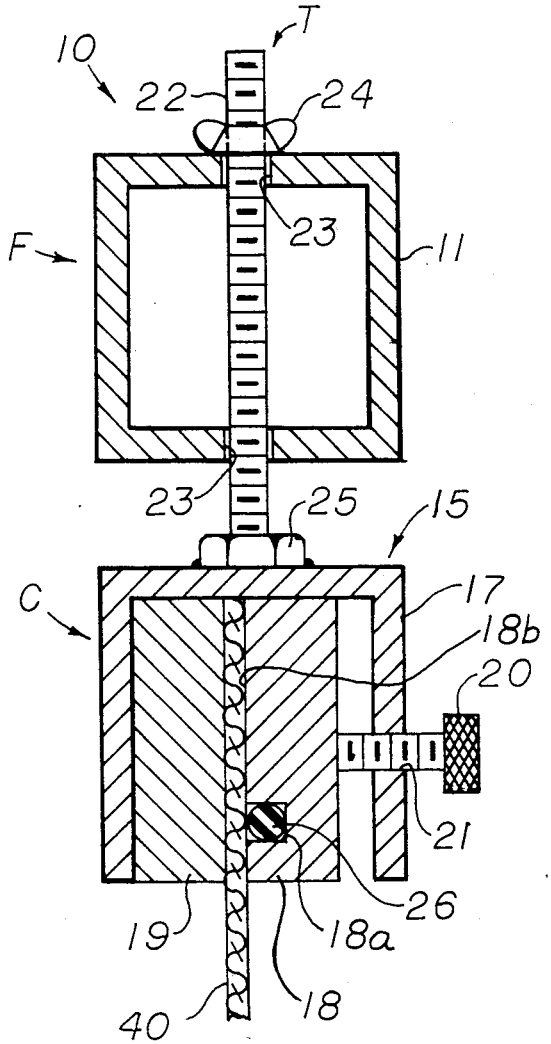
FIG. 3 is a cross-section view taken along line 3—3 of FIG. 2, showing an outer frame member and a clamping assembly with a sheet-like member.

Referring to FIG. 3, one embodiment of the tentering frame 10 is shown consisting essentially of a clamping assembly C attached to a hollow outer frame member F with a fastening/tentering means T. The fastening/tentering means T of tentering frame 10 comprises, for example, a threaded bolt or rod 22 extending through a bore 23 in the outer frame member F, a wing nut 24 threaded on the rod 22 and positioned on the outer surface of outer frame F and a means for attaching the rod 22 to the clamping assemblies C. Any means for attaching the rod 22 to the clamping assemblies may be used, such as welding or threading. In this embodiment, a nut 25 is welded to the bottom of the "U" or web of the U-shaped clamp channel 17 and the threaded rod 22 is threaded to the nut 25. At least a pair of fastening/tentering means T are attached to the clamping assemblies 15 and 16, but any number of fastening/tentering T means may be used.

Referring again to FIG. 3, a means for tightly securing or gripping the sheet-like member 40 between clamping bars 18 and 19 is provided on at least one of the clamping bars. The gripping means, in this instance, may be, for example, a securing member 26 and a longitudinal recess **18*a* adapted to receive the securing member 26. The recess 18*a* is positioned along the inner surface 18*b* of bar 18 in contact with the sheet-like member 40. The securing member 26 may be in the form of a solid piece, a strip or a tubing. Preferably, the securing member 26 may be made of resilient materials such as rubber, ethylene-propylene-diene monomer (EPDM), chlorinated polyethylene (CPE) and neoprene. The recess 18*a* and securing member 26 provides a tightly secured or gripped sheet-like member 40 during tentering, stretching or tensioning the sheet-like member 40**. Another gripping means (not shown) useful in the present invention may be, for example, a longitudinal rib on at least one clamping bar and a longitudinal recess adapted for receiving the rib on at least the other clamping bar. Other gripping means (not shown) may include, for example, a knurled surface or roughened, uneven surface located on at least a portion of the inner surface of at least one clamping bar in contact with the sheet-like member.

Figure 4:
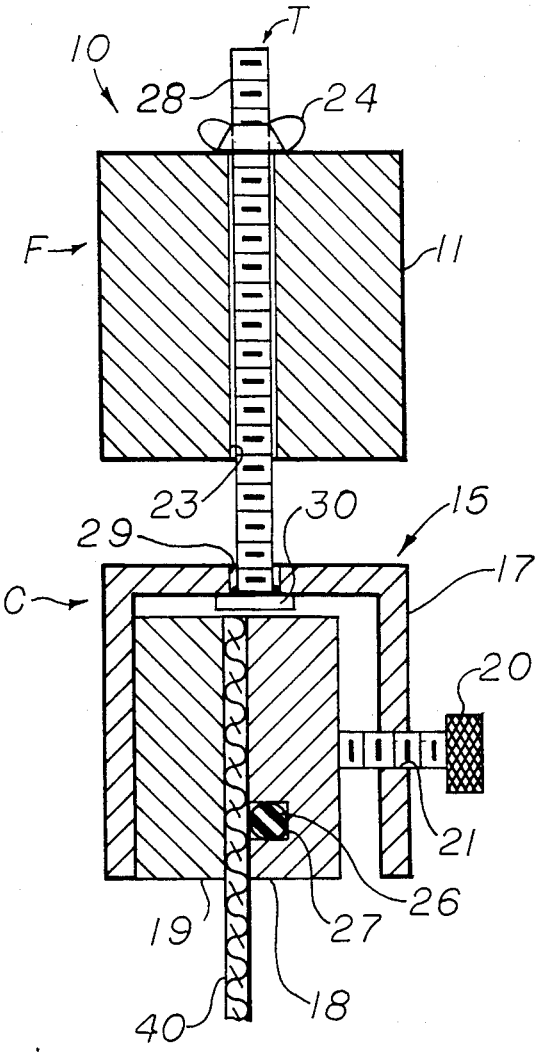
FIG. 4 is a cross-section view, similar to FIG. 3, of another embodiment of the apparatus according to the present invention, showing an outer frame member and a clamping assembly with a sheet-like member.

With reference to FIG. 4, another embodiment of the tentering frame 10, similar to FIG. 3, is shown consisting essentially of a clamping assembly C attached to a solid outer frame member F with a fastening/tentering means T. The fastening/tentering means T in this embodiment is, for example, a threaded rod 28 extending through a bore 23 positioned in the web of the U-shaped clamp channel 17. A flat head 30 on one end of the rod 28 retains the rod 28 to the U-shaped clamp channel 17. Optionally, the flat head 30 may be welded to the bore 23. A wing nut 24 is threaded on the rod 28 and is positioned on the outer surface of outer frame member F.

Figure 5:
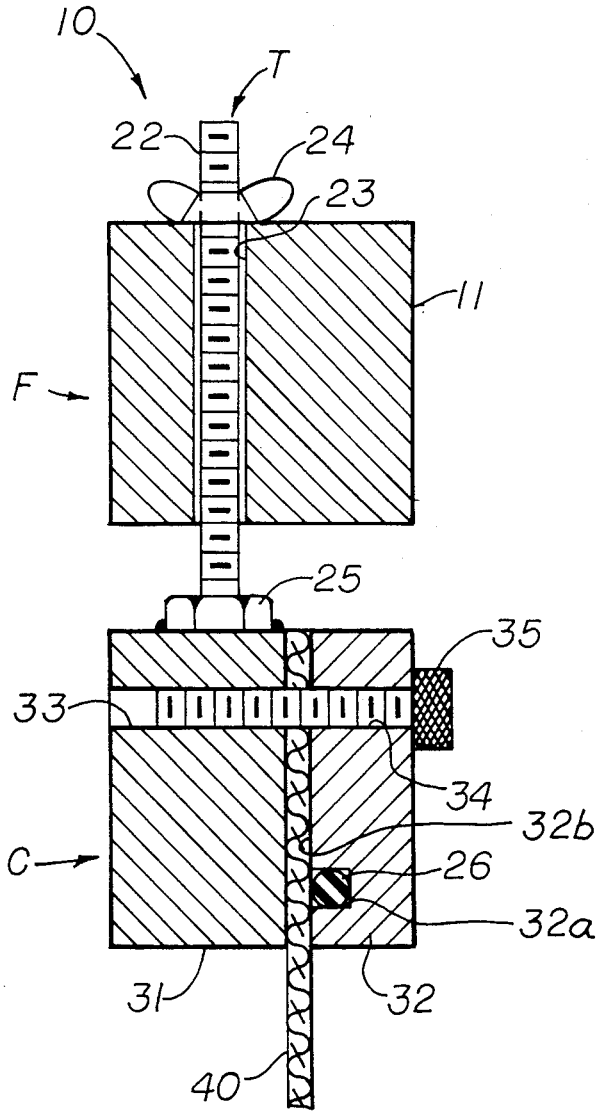
FIG. 5 is a cross-section view, similar to FIG. 3, of another embodiment of the apparatus according to the present invention, showing an outer frame member and a clamping assembly with a sheet-like member.
Figure 6:
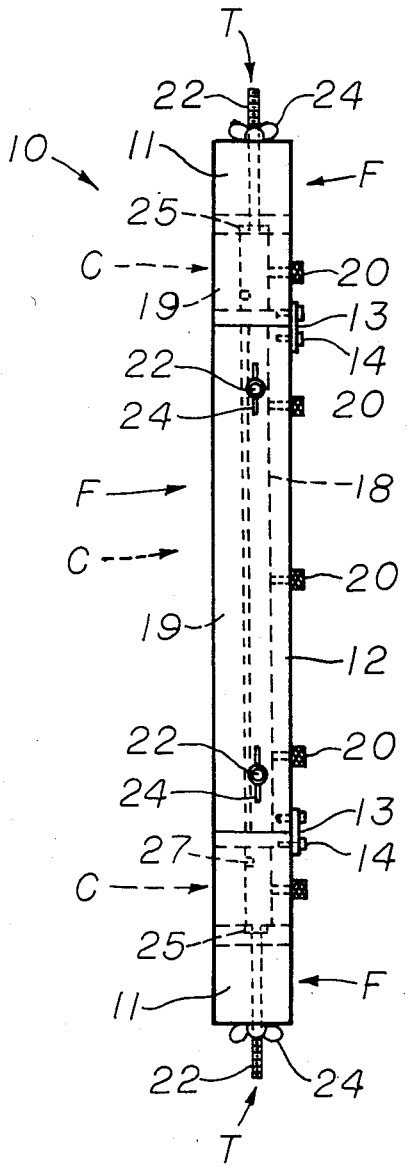
FIG. 6 is a side view of the assembled tentering apparatus of FIG. 1.

FIG. 5 shows another embodiment of the tentering frame 10 consisting essentially of a clamping assembly C attached to a solid outer frame F with a fastening/tentering means T. The fastening/tentering means T, similar to FIG. 3, in this embodiment is, for example, a threaded rod 22 extending through a bore 23 in the outer frame member F, a wing nut 24 positioned on the outer frame surface and a means for attaching the rod 22 to the clamping assemblies C. The clamping assemblies C, in this instance, consist essentially of two clamping bars 31 and 32 with threaded bores 33 and 34, respectively, with a clamping screw 35 used to tighten the clamping bars 31 and 32 together. A means for gripping the sheet-like member 40 in this instance, may be a securing member 26 and a recess **32*a* on the inner planar surface of clamping bar 32 similar to the recess 18*a* and securing member 26 shown in FIG. 3 above. Other gripping means may be used as described above for FIG. 3**.

In a preferred method of carrying out the stretching or tensioning of the sheet-like member using the tentering frame 10 of the present invention, the edges of two opposite and generally parallel ends of a sheet-like member 40 are sandwiched between clamping bars 18 and 19 of clamping assemblies 15 and the edges of the sheet-like member 40 are secured by tightening the clamping screws 20. The two remaining edges of the ends of the sheet-like member 40 are sandwiched between clamping bars 18 and 19 of clamping assemblies 16 and the edges of the sheet-like member 40 are secured by tightening the clamping screws 20. The sections 11 and 12 of the outer frame member F are attached to the clamping assemblies 15 and 16, respectively, using the fastening/tentering means T. The sections 11 and 12 are fused together by the plate 13 and bolts 14. The wing nuts 24 on the outer frame section 11 are then tightened, to pull the sheet-like member in a direction perpendicular to the clamping assemblies 15. Then, the wing nuts 24 on the outer frame section 12 are tightened to pull the sheet-like member in a direction perpendicular to the clamping assemblies 16. The wing nuts may be tightened until any wrinkles formed on the surface of the sheet-like member 40 are removed or a desired tautness is achieved.

In its broadest application, the apparatus of the present invention may be used where a generally planar sheet-like member is desired to be tensioned or stretched. For example, the apparatus of the present invention is particularly useful for tensioning membranes employed in electrolyzers, in particular, electrolyzers of the filter press-type, which may be monopolar or bipolar. Such electrolyzers may be used, for example, for the production of chlorine and an alkali metal hydroxide by processes well known in the art. Examples of such electrolyzers are described in U.S. Pat. Nos. 4,108,742 and 4,111,779.

Membranes which are tensioned by the apparatus of the present invention and which are used in electrolytic cells of the filter press-type include, for example, flexible membranes having ion exchange properties and which are substantially impervious to the hydrodynamic flow of electrolyte and the passage of gas products produced in the cell. Cation exchange membranes succh as those composed of fluorocarbon polymers having a plurality of pendant sulfonic acid groups or carboxylic acid groups or mixtures of sulfonic acid groups and carboxylic acid groups are typically employed in electrolytic cells. The terms "sulfonic acid groups" and "carboxylic acid groups" are meant to include salt of sulfonic acid or salts of carboxylic acid which are suitably converted to or from the acid group by processes such as hydrolysis. One example of a suitable membrane of the sulfonic acid type cation exchange membranes are those sold commercially by E. I. duPont de Nemours and Company under the trademark Nafion ®. Carboxylic acid type cation exchange membranes are commercially available from the Asahi Glass Company under the trademark Flemion ®.

What is claimed is:

1. A tentering apparatus for tensioning a sheet-like member comprising:

(a) an outer frame member arranged in a picture frame type configuration with an inside and outside perimeter, (b) at least four clamping assemblies adjacent to each other and arranged in a picture frame type configuration within the inside perimeter of the outer frame member and spaced apart from the outer frame member, each of the clamping assemblies adapted for clamping the edges of the sheet-like member to hold the sheet-like member generally flat, and each of the clamping assemblies comprising at least two elongated, generally planar members adjacent and parallel to each other, and held together with a first fastening means including at least one clamp screw, the edges of the sheet-like member disposed between the two elongated members and disposed generally planar to the plane of the sheet-like member, and (c) an adjustable second fastening means including a plurality of wing nuts and bolts for fastening the clamping assemblies to the outer frame member, the second fastening means adapted for fixedly tensioning the sheet.

2. The apparatus of claim 1 wherein at least one of the two elongated, generally planar members contains a means for gripping the sheet-like member.

3. The apparatus of claim 2 wherein the gripping means is defined by a securing member and a recess.

4. The apparatus of claim 3 wherein the securing member is made of resilient material.

5. The apparatus of claim 4 wherein the securing member is made of materials selected from the group consisting of rubber, ethylene propylene diene monomer, chlorinated polyethylene and neoprene.

6. The apparatus of claim 1 wherein the first fastening means includes at least one U-shaped channel.

7. The apparatus of claim 1 wherein the sheet-like member is a membrane.

8. The apparatus of claim 7 wherein the membrane is adapted for use in an electrolyzer.

9. The apparatus of claim 8 wherein the electrolyzer is adapted for use in producing a halogen and an alkali metal hydroxide.

* * * * *